United States Patent [19]

Ohashi et al.

[11] Patent Number: 4,835,095

[45] Date of Patent: May 30, 1989

[54] PHOTOSENSITIVE TABULAR CORE/SHELL SILVER HALIDE EMULSION

[75] Inventors: Yuichi Ohashi; Yoshihiko Shibahara; Katsumi Makino; Hiroshi Takehara, all of Kanagawa, Japan

[73] Assignee: Fuji Photo Film Co., Ltd., Kanagawa, Japan

[21] Appl. No.: 10,600

[22] Filed: Feb. 3, 1987

[30] Foreign Application Priority Data

Feb. 3, 1986 [JP] Japan ..... 61-21685

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS 4,414,306 11/1983 Wey et al. ..... 430/434
4,433,048 2/1984 Solberg et al. ..... 430/434
4,665,012 5/1987 Sugimoto et al. ..... 430/569
4,668,614 5/1987 Takada et al. ..... 430/570

FOREIGN PATENT DOCUMENTS 0147868 7/1985 European Pat. Off. ..... 430/567

*Primary Examiner*—Mukund J. Shah
*Attorney, Agent, or Firm*—Sughrue, Mion, Zinn, Macpeak & Seas

[57] ABSTRACT

A photosensitive silver halide emulsion whose grain diameter/grain thickness ratio is 5 or more. The grains of the emulsion each comprises a core that consists substantially of silver bromoiodide containing from 4 to 20 mol % of silver iodide, and a shell that covers the core and consists substantially of silver bromide or silver bromoiodide containing 3 mol % or less of silver iodide, and the relative standard deviation of the silver iodide content among the grains of the emulsion is 20% or less.

26 Claims, 1 Drawing Sheet

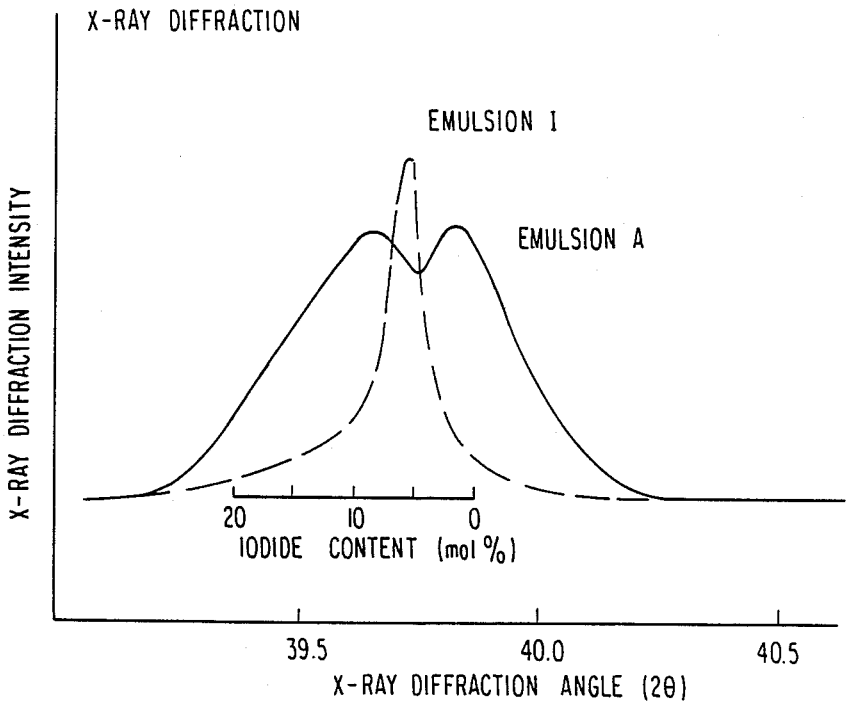
X-RAY DIFFRACTION
EMULSION I
EMULSION A
X-RAY DIFFRACTION INTENSITY
20
10
0
IODIDE CONTENT (mol %)
39.5
40.0
40.5
X-RAY DIFFRACTION ANGLE (2θ)

PHOTOSENSITIVE TABULAR CORE/SHELL SILVER HALIDE EMULSION

FIELD OF THE INVENTION

The present invention relates to tabular grain silver halide emulsions, and particularly to high sensitive photosensitive silver halide emulsions capable of providing images improved in contrast, graininess, transparency, and sharpness.

BACKGROUND OF THE INVENTION

In recent years, requirements for photographic silver halide emulsions have become increasingly severe, and higher levels of photographic performance, including high sensitivity, high contrast, excellent, graininess, and excellent sharpness have been required.

To satisfy such requirements, techniques using tabular grains that intend to improve sensitivity including color sensitization efficiency by sensitizing dyes, and to improve sensitivity/graininess relationship, sharpness, and covering power are disclosed in U.S. Pat. Nos. 4,434,226, 4,414,310, 4,433,048, 4,414,306, and 4,459,353.

The inventors have extensively studied the tabular grains disclosed in the above patents, but have not obtained a fully satisfactory sensitivity/graininess ratio.

This is attributed to the fact that if only the configuration of grains is made tabular, the absorbed amount of the sensitizing dye is increased in proportion to the increase in the surface area/volume ratio, and an increase in sensitivity corresponding to the increase in the amount of absorbed light is not expected. That is, the decrease in the sensitivity due to development restraint, recombination of an electron and a hole, and latent image dispersion caused by the increase in the absorbed amount of the sensitizing dye is great.

In the case where tabular grains are used in a blue-sensitive light-sensitive layer, it is required to increase the amount of absorbed light in the wavelength region inherent to silver halide grains.

To eliminate the above disadvantages and to obtain high sensitivity and high image quality, it is essential to increase the iodide content of emulsions.

The transparency of silver halide emulsion layers is attributed greatly to the effect of light scattering due to the variety of geometrical configuration of grains of emulsion, and in the layer positioned under a layer where the light scattering is high, the sharpness is lowered due to the light scattering in the upper layer.

In *Research Disclosure,* RD No. 25330 (May 1985), the relationship between the configuration of grains of emulsion and the light scattering is described, and it is to be understood that to improve the sharpness of silver halide photosensitive materials, it is essential to improve the transparency of grains of emulsion.

The light absorption increases in the order of silver chloride, silver bromide, and then silver iodide, and on the other hand the development activity decreases in the stated order, so that it is difficult to secure both light absorption and development activity at the same time.

To overcome this problem, there can be considered the provision of the structure of grains of a silver halide emulsion with a distinct layer structure. That is, the inner core part is made to be a high iodide content phase and the outer shell part is made to be a low iodide content phase, in order to secure both light absorption and development activity.

Japanese Patent Application (OPI) No. 99433/84 (the term "OPI" as used herein refers to a "published unexamined Japanese patent application") discloses a method of improving pressure effect (sensitization or desensitization caused by pressure) by using tabular silver halide grains having a grain diameter/grain thickness ratio of 5 or more (i.e., 5/1 or more) and a high iodide content inner phase.

We, the inventors, have studied the above Japanese patent application (OPI) and have not been able to obtain a fully satisfactory result.

In the above Japanese patent application (OPI), since the high iodide content inner phase and the outer phase are formed in the presence of a thioether serving as a silver halide solvent, a distinct layer structure cannot be substantially obtained, and since iodide migrates to the outer phase, the development activity is significantly lowered, to thereby lower the sensitivity.

On the other hand, Japanese Patent Application (OPI) No. 143331/85 discloses a method for producing silver halide emulsions high in iodide content and development activity by making the structure of silver halide grains to be a distinct layer structure having a core part with a high iodide content and a shell part with a low iodide content.

When the above technique is applied to tabular grains having an aspect ratio of 5 or more, the improvement in the sensitivity/graininess ratio has not been fully satisfactory. The inventors have analyzed intensively the cause, and have reached a hypothesis to the effect that when the iodide content deviation among grains of core parts is broad, the grain size distribution after adding the shell is apt to be broad, and the larger the size of the grains, the lower the iodide content becomes.

Based on this hypothesis, the inventors have studied the conditions of the preparation of grains of emulsion and have discovered that when the iodide content deviation among grains is narrow and the size distribution is narrow, the sensitivity/graininess ratio of tabular grains is quite excellent.

In European Patent No. 147,868A, it is disclosed that the sensitivity/graininess ratio can be improved by narrowing the iodide content deviation among grains of a core/shell type emulsion, but it is not disclosed at all that when the iodide content deviation among grains of core parts is broad, the grain size distribution becomes great, and the greater the grain size, the smaller the iodide content becomes. There is no description with respect to tabular grains in that patent. Therefore, it has been quite difficult to expect the effect of the present invention.

SUMMARY OF THE INVENTION

The object of the invention is to provide a high sensitive tabular grain silver halide emulsion capable of providing images improved in contrast, graininess, transparency, and sharpness.

The inventors have intensively studied the matter, and have found that the object of the present invention can be attained by the silver halide emulsion described below. That is, the present invention provides a photosensitive silver halide emulsion whose grain diameter/grain thickness ratio is 5 or more, wherein the grains of the emulsion each comprises a core that consists substantially of silver bromoiodide containing from 4 to 20 mol % of silver iodide, and a shell that covers the core and consists substantially of silver bromide or silver bromoiodide containing 3 mol % or less of silver iodide, and the relative standard deviation of the silver iodide content among the grains of the emulsion is 20% or less.

BRIEF DESCRIPTION OF THE DRAWING

The drawing shows peak profiles of the X-ray diffraction of Emulsions A and I prepared in Example 1, wherein the diffraction angle (2θ) is plotted as abscissa and the X-ray diffraction intensity as ordinate.

DETAILED DESCRIPTION OF THE INVENTION

The tabular silver halide grains (hereinafter referred to as "tabular grains") used in the present invention preferably have a diameter/thickness ratio of from 5 to 20, more preferably from 5 to 8, and most preferably from 6.5 to 8.

The diameter of a tabular grain refers to the diameter of a circle having an area equal to the projected area of the grain. Generally, a tabular grain has two parallel planes and therefore the term "thickness" used herein is represented by the distance between the two parallel planes constituting the tabular grain.

The tabular grain in the present invention has a structure consisting of a core and a shell covering the core. The core consists substantially of silver bromoiodide containing from 4 to 20 mol % of silver iodide, and preferably consists substantially of silver bromoiodide containing from 6 to 15 mol % of silver iodide. The core may contain the silver iodide uniformly or may have a multiple structure with phases different in the silver iodide content. In the latter case, the average value of the silver iodide content of the core may be from 4 to 20 mol % and more preferably is from 6 to 15 mol %. The expression "consists substantially of silver bromoiodide" means that the core consists mainly of silver bromoiodide but may contain other constituents in an amount of up to about 1 mol %. It is desirable that the silver iodide content of the cores among the grains is fairly uniform from grain to grain, and it is preferable that the relative standard deviation of the silver iodide content among the cores of the grains is 15% or less, and more preferably 8% or less.

The shell of the tabular grain of the present invention consists substantially of silver bromide or silver bromoiodide containing 3 mol % or less of silver iodide, and more preferably consists substantially of silver bromide or silver bromoiodide containing 1.5 mol % or less of silver iodide. The expression "consists substantially of silver bromide or silver bromoiodide" means that the shell consists mainly of silver bromide or silver bromoiodide but may contain other constituents in an amount of up to about 1 mol %.

The volume ratio of the core to the shell of the tabular grains of the present invention is generally from ¼ to 4/1, and preferably from ½ to 2/1.

In the shell of the tabular grain of the present invention, the average thickness in the Z-axis direction is from 0.01 to 0.1 μm and preferably from 0.02 to 0.06 μm, and the average thickness in the X-Y plane direction is from 0.02 to 0.5 μm and preferably from 0.05 to 0.4 μm. The ratio of the thickness in the Z-axis direction to the thickness in the X-Y plane direction is from 1/1 to 1/20, preferably from 1/1 to ⅛, and more preferably from 1/1 to 1/5. Herein, by "Z-axis direction" is meant the direction perpendicular to the two parallel planes constituting the tabular grain, and by "X-Y plane direction" is mean the direction parallel to the two parallel planes.

The diameter of the tabular grain of the present invention that corresponds to the diameter of a circle having an area equal to the projected area of the grain is generally from 0.2 to 3.0 μm, and preferably from 0.3 to 2.0 μm.

In the tabular grain of the present invention, the relative standard deviation of the silver iodide content among the grains is 20% or less, and preferably 12% or less.

The silver iodide content of grains of emulsion can be measured by analyzing the composition of each particle by using, for example, an X-ray microanalyzer. Herein, by the "relative standard deviation of the silver iodide content among the grains" is meant the value found by dividing the standard deviation of the silver iodide content calculated from the silver iodide content of at least 100 grains of emulsion obtained using, for example, an X-ray microanalyzer, by the average silver iodide content and multiplying the obtained value by 100. An embodiment of a method of determining the silver iodide content of individual grains of emulsion is described, for example, in European Pat. No. 147,868A.

If the relative standard deviation of the silver iodide content among the grains is large, the suitable point of chemical sensitization is different from grain to grain and it becomes impossible to obtain the performance of every grain of emulsion. In core/shell type tabular grains increased in the efficiency of the sensitization by dyes due to tabularization and also increased in the efficiency of utilization of the impinged light by the core/shell type structure to cause the functions of the grains of emulsion from the receipt of light to the formation of an image to be separated as far as possible into the core parts and the shell parts, the effect for making the silver iodide contents among grains uniform is surprisingly great, and the sensitivity/graininess ratio achievable has been increased remarkably.

Between the silver iodide content Yi (mol %) of each grain and the grain size Xi (μm) of each grain, there is a mutual relation in some cases, and there is no mutual relation in other cases. In the case where there is a positive mutual relation, that is, in the case where the greater the size of the grain, the higher the silver iodide content, the development of large-sized grains will not proceed fully, and dead grains increase, which causes the sensitivity/graininess ratio to be affected adversely. On the other hand, in the case where a negative mutual relation, that is, in the case where the larger the size of the grain, the lower the silver iodide content, the development of the large-sized grains will proceed excessively, which causes the graininess to be affected adversely. For this reason, it is desirable that there is no mutual relation between the silver iodide content and the grain size of each grain. If there is a mutual relation, preferably the slope of the straight line determined by the method of least squares from the points of (Xi, Yi) is up to 7 (mol %/μm), and more preferably up to 2 (mol %/μm). However, basically it is most preferable that there is no silver iodide content deviation among the grains.

The core/shell structure of the tabular grains of the present invention can be confirmed by the following analysis. That is, using the Kβ line of Cu with the angle of diffraction (2θ) being in the range of from 38° to 42°, when a curve of the diffraction intensity to the diffraction angle of the (220) plane of the silver halide crystal is obtained, both the diffraction peak corresponding to the core part and the diffraction peak corresponding to the shell part can be observed. When a particularly preferable core/shell structure is attained, two diffraction maximums, that is, the diffraction peak corresponding to the core part and the diffraction peak corresponding to the shell part, and a minimum between them appear, the diffraction intensity corresponding to the core part is from 1/10 to 3/1, preferably from $\frac{1}{3}$ to 3/1, of that of the shell part.

When grains of emulsion have the core/shell structure as described above, the silver iodide content of the surface of the grains of emulsion determined using an X-ray photoelectron spectrometer (XPS) will be a value smaller than the average silver iodide content of the grains of emulsion determined, for example, by the fluorescence X-ray method.

When the present tabular grains are observed by Hirsch's method described in *Journal of Photographic Science,* Vol. 10 (1962), page 129, the double structure can usually be confirmed.

Tabular grains can be produced by the methods described in *Photographic Theory Practice* by Cleve, page 131 (1930) and *Photographic Science and Engineering* by Gutoff, Vol. 14, pages 248 to 257 (1970), U.S. Pat. Nos. 4,434,226, 4,416,306, 4,414,310, 4,433,048, and 4,439,520, European Patent No. 111,919A2 and British Patent No. 2,112,157, etc., and a combination of methods known to those skilled in the art.

For example, seed crystals wherein tabular grains are present in an amount of 40 wt % are formed in an atmosphere of a relatively high pAg value with the pBr being up to 1.3, and silver and halogen solutions are added simultaneously with a suitable pBr being kept to grow the seed crystals.

In this course of the growth of the grains, it is desirable that silver and halogen solutions are added to prevent new crystal nuclei from being produced.

Particularly, in the growth of the high iodide phase, it is required that conditions should be carefully selected so as to minimize the growth in the direction of the thickness.

Further, in the growth of the shell phase, it is required that conditions should be selected carefully so as to minimize the migration of iodide from the high iodide core phase to the shell phase.

The above conditions of growth can be regulated by adjusting the pAg, selecting the type of solvent or its amount, and controlling the speed of addition of the silver salt and halide that are used at the time of the growth of grains.

To facilitate the ripening, silver halide solvents are useful. For example, it is known that the presence of an excess amount of halogen ions in a reactor can facilitate the ripening. Therefore, it is obvious that only if a halide salt solution is introduced into a reactor, the ripening can be facilitated. Other ripening agents can be used, and the whole amount of the ripening agent may be incorporated in a dispersant in a reactor before the introduction of silver and halide salts, or the ripening agent may be introduced together with one or more halide salts, and silver salts or a deflocculant into a reactor. In an another mode, the ripening agent can be introduced separately when halide salts and silver salts are added.

As ripening agents other than halogen ions can be used ammonia, amine compounds, thiocyanates such as alkali metal thiocyanates, in particular sodium and potassium thiocyanates and ammonium thiocyanate. Use of thiocyanate ripening agents is taught in U.S. Pat. Nos. 2,222,264, 2,448,534, and 3,320,069. Commonly used thioether ripening agents described in U.S. Pat. Nos. 3,271,157, 3,574,628, and 3,737,313 can also be employed. Thion compounds as disclosed in Japanese Patent Application (OPI) Nos. 82408/78 and 144319/78 can also be used.

By allowing various compounds to be present in the course of the formation of precipitation of silver halides, the properties of the silver halide grains can be controlled. Such compounds may be allowed to be present initially in a reactor, or may be added together with one or more salts in a usual manner. As described in U.S. Pat. Nos. 2,448,060, 2,628,167, 3,737,313, and 3,772,031, and *Research Disclosure,* Vol. 134, RD No. 13452 (June 1975), the properties of the silver halide can be controlled by allowing compounds such as compounds of copper, iridium, lead, bismuth, cadmium, zinc, (chalcogenides including sulfur, selenium, and tellurium), gold, and Group VIII noble metals such as platinum, ruthenium, rhodium, iridium, etc., to be present in the course of the formation of precipitation of the silver halide. The silver halide emulsion wherein the inner part of grains is reduction-sensitized in the course of the formation of precipitation can be used as disclosed in Japanese Patent Publication No. 1410/83 and *Journal of Photographic Science* by Moisar et al., Vol. 25, pages 19–27 (1977).

Tabular grains used in the present invention may have a silver halide having a different composition or a compound other than silver halides such as silver thiocyanate or lead oxide joined by epitaxial junction. Such emulsion grains are disclosed in U.S. Pat. Nos. 4,093,684, 4,142,900, 4,459,353, 4,349,622, 4,395,478, 4,433,501, 4,463,087, 3,656,962, and 3,852,067, British Patent No. 2,038,792, Japanese Patent Application (OPI) No. 162540/84, etc.

Generally, the tabular grains used in the present invention are chemically sensitized.

Chemical sensitization can be carried out by using active gelatin as described by T. H. James, *The Theory of the Photographic Process,* 4th ed., pages 67–76, Macmillan (1977), or can be carried out by using sulfur, selenium, tellurium, gold, platinum, palladium, or iridium, which may also be used in combination with each other, at a pAg of from 5 to 10, preferably a pH of from 5 to 8, and a temperature of from 30° to 80° C. as described in *Research Disclosure,* Vol. 120, RD No. 12008 (April 1974), *Ibid.,* Vol. 134, RD No. 13452 (June 1975), U.S. Pat. Nos. 2,642,361, 3,297,446, 3,772,031, 3,857,711, 3,901,714, 4,266,018, and 3,904,415, and British Patent No. 1,315,755. Most suitably, chemical sensitization is carried out in the presence of a gold compound and a thiocyanate compound or in the presence of a sulfur-containing compound such as hypo, thiourea type compounds and rhodanine type compounds or a sulfur-containing compound as described in U.S. Pat. Nos. 3,857,711, 4,266,018, and 4,054,457. Chemical sensitization can be carried out in the presence of a chemical sensitization assistant. Chemical sensitization assistants that can be used include compounds such as azaindene, azapyridazine, and azapyrimidine that are known to increase sensitivity and to suppress fogging in the course of chemical sensitization. Examples of chemical sensitization assistant modifiers are described, for example, in U.S. Pat. Nos. 2,131,038, 3,411,914, and 3,554,757, Japanese Patent Application (OPI) No.

126526/83, and *Photographic Emulsion Chemistry* by G. F. Duffin, pages 138–143. In addition to or instead of chemical sensitization, reduction sensitization using, for example, hydrogen can be carried out as described in U.S. Pat. Nos. 3,891,446 and 3,984,249 or reduction sensitization by using a reducing agent such as polyamines, thiourea dioxide, and stannous chloride or by treating at a low pAg (e.g., less than 5) and/or a high pH (e.g., higher than 8) can be carried out as described in U.S. Pat. Nos. 2,518,698, 2,743,182, and 2,743,183. Color sensitivity can be improved by the chemical sensitization method as described in U.S. Pat. Nos. 3,917,485 and 3,966,476.

The sensitization method that uses oxides as described in Japanese Patent Application Nos. 122981/84 and 122984/84 (corresponding to Japanese Patent Application (OPI) Nos. 3134/86 and 3136/86, respectively) can be applied.

Tabular grains used in the present invention can be used in the same silver halide emulsion layer in combination with other silver halide grains (hereinafter referred to as non-tabular grains) that are chemically sensitized in a usual manner, and in particular in the case of color photographic materials, tabular grains and non-tabular grains can be used in respective different emulsion layers and/or the same emulsion layer. Non-tabular grains include regular grains in the shape of a regular crystal (e.g., cubic, octahedral, tetradecahedral, etc.) and irregular grains in the shape of an irregular crystal (e.g., spherical, pebble-like, etc). As a silver halide for these grains can be used any of silver bromide, silver bromoiodide, silver bromochloroiodide, silver chlorobromide, and silver chloride. A preferable silver halide is silver bromoiodide or silver bromochloroiodide containing up to 30 mol % of silver iodide. A particularly preferable silver halide is silver bromoiodide containing from 2 to 25 mol % of silver iodide.

Non-tabular grains used herein may be fine grains having a grain diameter of up to 0.1 μm, or large-sized grains the diameter of the projected area of which is up to 10 μm, and a monodisperse emulsion having a narrow grain size distribution or a polydisperse emulsion having a wide grain size distribution can be used.

Non-tabular grains used in the present invention can be prepared by the methods described by P. Glafkides in *Chimie et Physique Photographique,* Paul Montel (1967), by G. F. Duffin in *Photographic Emulsion Chemistry,* Focal Press (1966), and by V. L. Zelikman et al. in *Making and Coating Photographic Emulsion,* Focal Press (1964). That is, non-tabular grains used in the present invention can be prepared by any one of the acid method, the neutral method, the ammonia method, etc., and the reaction of a soluble silver salt with a soluble halide can be effected by the single-jet method, the double-jet method, or a combination thereof. A method where the grains are formed in the presence of excess silver ions, that is, the so-called reverse mixing method, can also be used. A method that is one type of the double-jet method that can be used is the so-called controlled double-jet method, wherein the pAg in the liquid phase in which a silver halide will be formed is kept constant. According to this last mentioned method, a silver halide emulsion where the crystal form is regular and the grain size is substantially uniform can be obtained. Two or more silver halide emulsions prepared separately can be mixed to be used.

The silver halide emulsion consisting of regular crystals mentioned above can be obtained by controlling the pAg and the pH during the formation of the grains. Details regarding this are described, for example, in *Photographic Science and Engineering,* Vol. 6, pages 159–165 (1962); *Journal of Photographic Science,* Vol. 12, pages 242–251 (1964); and U.S. Pat. No. 3,655,394 and British Patent No. 1,413,748.

With respect to monodisperse emulsions, references may be made to Japanese Patent Application (OPI) Nos. 8600/73, 39027/76, 83097/76, 137133/78, 48521/79, 99419/79, 37635/83, and 49938/83, Japanese Patent Publication No. 11386/72, U.S. Pat. No. 3,655,394, British Patent No. 1,413,748, etc.

The crystal structure of these non-tabular grains may be uniform, may be one having a halogen composition whose outer part and inner part are different, or may be a layer structure. Examples of such emulsion grains are disclosed in British Patent No. 1,027,146, U.S. Pat. Nos. 3,505,068 and 4,444,877, Japanese Patent Application No. 248469/83 (corresponding to Japanese Patent Application (OPI) No. 14331/85), etc.

In the present invention, a photo-insensitive fine grain emulsion having a grain size of up to 0.6 μm, and preferably up to 0.2 μm, may be added into a silver halide emulsion layer, an intermediate layer or a protective layer for the purpose, for example, of accelerating the development, of improving the storability and of effectively using the reflected light.

Preferably, the tabular grains of the present invention are used in color photosensitive materials for photography. More particularly, the tabular grains of the present invention are typically used in color negative photosensitive materials for photography.

When the tabular grains of the present invention are used in the same emulsion layer as that of, in particular, non-tabular monodisperse silver halide grains and/or a different emulsion layer from that of, in particular, non-tabular monodisperse silver halide grains, the sharpness and the graininess can be simultaneously improved in some cases.

Herein, by "monodisperse silver halide emulsions (non-tabular grains)" is meant emulsions wherein 95% or more of the total weight or the total number of the silver halide grains contained therein are within the average grain diameter ±40%, and preferably ±30%. Possible improvement of the graininess by using monodisperse silver halide emulsions in silver halide photographic material is described in the above-cited Japanese Patent Publication No. 11386/72, Japanese Patent Application (OPI) Nos. 142329/80, 17235/82, and 72440/84, etc. As described by T. H. James in *The Theory of the Photographic Process,* pages 580–585, cited above, monodisperse silver halide grains having a grain size of from 0.3 to 0.8 μm are known to have such the property that light scattering for light with a specific wavelength region is great, while light scattering for light with other wavelengths is low.

Therefore, in some cases, by suitably arranging tabular grain silver halide emulsions having a grain diameter/thickness ratio of 5 or more and monodisperse silver halide emulsions while taking the optical properties and graininess of these silver halide emulsions into consideration, the sharpness and the graininess of the silver halide photographic material can be improved simultaneously.

Examples of such cases are mentioned below.

Example (1): In a photosensitive material wherein a red-sensitive layer, a green-sensitive layer, and a blue-sensitive layer are arranged on a support in the stated order, if the average grain diameter of silver halide grains contained in a silver halide emulsion layer constituting the blue-sensitive layer ranges from 0.3 to 0.8 μm, use is made of tabular silver halide grains in the emulsion layer, while if the average grain diameter falls outside of the above range, by using a monodisperse silver halide it is possible to improve the sharpness of the green-sensitive layer and the red-sensitive layer and to improve the graininess of the blue-sensitive layer.

Example (2): In a photosensitive material having the same layer arrangement as that in Example (1), if the average grain diameter of the silver halide grains contained in the silver halide emulsion layer constituting the green-sensitive layer ranges from 0.4 to 0.8 μm, tabular silver halide grains are used in the emulsion layer, while if the average grain diameter falls outside of the above range, it is possible to improve the sharpness of the red-sensitive layer as well as to improve the graininess of the green-sensitive layer by using a monodisperse emulsion.

Example (3): In a photosensitive material having the same layer arrangement as that of Example (1), if the emulsion layers having the same color sensitivity comprises two or more layers whose sensitivities are different, the most sensitive blue-sensitive layer contains a monodisperse silver halide (more preferably grains having a double structure) having 1.0 μm or more and the lower sensitive blue-sensitive layer is high in light scattering, it is possible to improve the sharpness of the green-sensitive layer and the red-sensitive layer by using tabular grains in the lower blue-sensitive layer.

Example (4): In a photosensitive material having the same layer arrangement as that of Example (3), if the light scattering is high in all of the green-sensitive layers, it is possible to improve the sharpness of the red-sensitive layer as well as the graininess of the green-sensitive layers by using tabular grains in all of the green-sensitive layers.

If a blue-sensitive layer, a green-sensitive layer, and a red-sensitive layer each consists of a plurality of emulsion layers as in Examples (3) and (4), it should be considered that tabular silver halide grains are used in the emulsion layers high in light scattering so as to improve the sharpness and the graininess and monodisperse emulsions are used in the emulsion layers low in light scattering. If tabular grains are used further in the red-sensitive layer in Example (4), in some cases the light scattering between the emulsion layers becomes high, to adversely affect the sharpness of the green-sensitive layer on the red-sensitive layer, and in some cases it is not preferable to use tabular grains in a red-sensitive layer nearest to the support.

The tabular grains and non-tabular grains used in the present invention are ones that have generally been subjected to physical ripening, chemical ripening, and spectral sensitization. Additives used in these steps are described in *Research Disclosure,* RD Nos. 17643 (Dec. 1978) and 18716 (Nov. 1979) and the involved parts thereof are summarized in Table below.

Known additives for photography that can be used in the present invention are described in *Research Disclosures* cited above, and the involved parts are shown in Table below.

| Kind of Additives | Research Disclosure No. 17643 | Research Disclosure No. 18716 |
|---|---|---|
| 1. Chemical Sensitizers | p. 23 | p. 648, right column |
| 2. Sensitivity Increasing Agents | | p. 648, right column |
| 3. Spectral Sensitizers and Supersensitizers | pp. 23–24 | p. 648, right column to p. 649, right column |
| 4. Whitening Agents | p. 24 | |
| 5. Antifoggants and Stabilizers | pp. 24–25 | p. 649, right column |
| 6. Light-Absorbers, Filter Dyes and Ultraviolet Absorbents | pp. 25–26 | p. 649, right column to p. 650, left column |
| 7. Antistaining Agents | p. 25, right column | p. 650, left column to right column |
| 8. Dye Image Stabilizers | p. 25 | |
| 9. Hardeners | p. 26 | p. 651, left column |
| 10. Binders | p. 26 | p. 651, left column |
| 11. Plasticizers and Lubricants | p. 27 | p. 650, right column |
| 12. Coating Aids and Surfactants | pp. 26–27 | p.650, right column |
| 13. Antistatic Agents | p. 27 | p. 650, right column |

Various color couplers can be used in the photosensitive material of the present invention, and examples thereof are described in patents cited in *Research Disclosure,* RD No. 17643, VII-C through VII-G. As dye-forming couplers, couplers, which can develop primary colors in the subtractive color process, that is, yellow, magenta, and cyan, are important and examples of non-diffusible 4-equivalent or 2-equivalent couplers are described in patents cited in *Research Disclosure,* RD No. 17643, VII-C and VII-D. In addition to these couplers, the following couplers can be preferably used in the present invention.

Typical examples of yellow couplers that can be used in the photosensitive material of the present invention are hydrohobic acylacetamido type couplers having a ballast group. Examples of such couplers are described in U.S. Pat. Nos. 2,407,210, 2,875,057, and 3,265,506, etc. For the present invention, the use of 2-equivalent yellow couplers is preferred, and typical examples thereof are yellow couplers having oxygen-atom-linked coupling-off group described in U.S. Pat Nos. 3,408,194, 3,447,928, 3,933,501, and 4,022,620, etc. and yellow couplers having nitrogen-atom-linked coupling-off group described in Japanese Patent Publication No. 10739/83, U.S. Pat. Nos. 4,401,752 and 4,326,024, *Research Disclosure,* RD No. 18053 (April 1979), British Patent 1,425,020, West German Patent Application (OLS) Nos. 2,219,917, 2,261,361, 2,329,587, and 2,433,812, etc. α-Pivaloylacetanilide type couplers are excellent in fastness of the dyes, particularly fastness to light. α-Benzoylacetanilide couplers give a high color density.

Magenta couplers that can be additionally used in the photosensitive material of the present invention are indazolone type couplers or cyanoacetyl type couplers, preferably 5-pyrazolone type couplers and pyrazoloazole type couplers which have a ballast group and are hydrophobic. Of 5-pyrazolone type couplers, couplers wherein the 3-position is substituted by an arylamino group or an acylamino group are preferred, in view of the hue of the dye and the color density, and typical examples thereof are described in U.S. Pat. Nos. 2,311,082, 2,343,703, 2,600,788, 2,908,573, 3,062,653, 3,152,896, and 3,936,015, etc. As coupling-off groups of 2-equivalent 5-pyrazolone type couplers, particularly preferred are nitrogen-atom-linked coupling-off groups described in U.S. Pat. No. 4,310,619 and arylthio groups described in U.S. Pat. No. 4,351,897. 5-Pyrazolone type couplers having a ballast group described in European Patent No. 73,636 can give a high color density. Pyrazoloazole type couplers include pyrazolobenzimidazoles described in U.S. Pat. No. 3,061,432, preferably pyrazolo[5,1-c][1,2,4]triazoles disclosed in U.S. Pat. No. 3,725,067, pyrazolotetrazoles described in *Research Disclosure,* RD No. 24220 (June 1984) and Japanese Patent Application (OPI) No. 33552/85 and pyrazolopyrazoles described in *Research Disclosure,* RD No. 24230 (June 1984) and Japanese Patent Application (OPI) No. 43659/85. In view of fastness to light and decrease of yellow subabsorption of dyes, imidazo[1,2-b]pyrazoles described in U.S. Pat. No. 4,500,630 are preferable, and pyrazolo[1,5-b][1,2,4]triazoles described in U.S. Pat. No. 4,540,654 are more preferable.

As cyan couplers that can be used in the photosensitive material in the present invention can be mentioned hydrophobic non-diffusible naphthol type and phenol type couplers, and typical examples thereof are naphthol type couplers described in U.S. Pat. No. 2,474,293 and preferred examples thereof are 2-equivalent naphthol type couplers having oxygen-atom-linked coupling-off group described in U.S. Pat. Nos. 4,052,212, 4,146,396, 4,228,233, and 4,296,200. Examples of the phenol type couplers are described in U.S. Pat. Nos. 2,369,929, 2,801,171, 2,772,162, 2,895,826, etc.

Cyan couplers that are fast to humidity and temperature are preferably used in the present invention, and typical examples of the cyan couplers are phenol type cyan couplers having an alkyl group having at least 2 carbon atoms in the meta-position of the phenol nucleus as described in U.S. Pat. No. 3,772,002, 2,5-diacylamino substituted phenol type couplers as described in U.S. Pat. Nos. 2,772,162, 3,758,308, 4,126,396, 4,334,011, and 4,327,173, West German Patent Application (OLS) No. 3,329,729, and European Patent 121,365, phenol type couplers having a phenylureido group in the 2-position and an acylamino group in the 5-position as described in U.S. Pat. Nos. 3,446,622, 4,333,999, 4,451,559, and 4,427,767, and others. Cyan couplers, the 5-position of the naphthol ring of which is substituted by a sulphonamido group or amido group are excellent in fastness of the color image, and are preferably used in the present invention.

To correct undesired absorption by dyes, it is preferable that a colored coupler is additionally used in color photosensitive material for photography to effect masking. Yellow colored magenta couplers described in U.S. Pat. No. 4,163,670, Japanese Patent Publication No. 39413/82, etc., or magenta colored cyan couplers described in U.S. Pat. Nos. 4,004,929 and 4,138,258, British patent No. 1,146,368 are typical examples thereof. Other colored couplers are described in the above-mentioned *Research Disclosure,* RD No. 17643, VII-G (Dec. 1978).

Couplers whose dyes have a suitable diffusability can be used additionally to improve the graininess. Examples of such couplers are magenta couplers described in U.S. Pat. No. 4,366,237 and British Patent No. 2,125,570 and yellow, magenta, or cyan couplers described in European Patent No. 96,570 and West German Patent Application (OLS) No. 3,234,533.

Dye-forming couplers and the above-mentioned specific couplers may be in the form of a dimer or higher polymer. Typical examples of polymerized dye-forming couplers are described in U.S. Pat. Nos. 3,451,820 and 4,080,211. Examples of polymerized magenta couplers are described in British Patent No. 2,102,173 and U.S. Pat. No. 4,367,282.

Couplers that will release a photographically useful residue group with the coupling can also be used preferably in the present invention. As development inhibitor-releasing (DIR) couplers, couplers described in patents described in the above-cited *Research Disclosure,* RD No. 17643, VII-F (Dec. 1978) are useful.

Typical DIR couplers that can be used in combination with the present invention include developing solution inactivating type DIR couplers as described in Japanese Patent Application (OPI) No. 151944/82, timing type DIR couplers as described in U.S. Pat. No. 4,248,962 and Japanese Patent Application (OPI) No. 154234/82, and reactive type DIR couplers as described in Japanese Patent Application No. 39653/84 (corresponding to Japanese Patent Application (OPI) No. 184248/85), and particularly preferable DIR couplers are developing solution inactivating type DIR couplers described in Japanese Patent Application (OPI) Nos. 151944/82 and 217932/83, Japanese Patent Application Nos. 75474/84, 82214/84, and 90438/84 (corresponding to Japanese Patent Application (OPI) Nos. 218644/85, 225156/85, and 233650/85, respectively), etc. and reactive type DIR couplers described in Japanese Patent Application No. 39653/84 (corresponding to Japanese Patent Application (OPI) No. 184248/85), etc.

In the photographic material of the present invention, couplers that will release a nucleus forming agent or a development accelerator or its precursor imagewise when development is effected can be used. Examples of such compounds are described in British Patent Nos. 2,097,140 and 2,131,188. Couplers that will release a nucleus forming agent having an effect for adsorbing a silver halide are particularly preferable and examples thereof are described in Japanese Patent Application (OPI) Nos. 157638/84 and 170840/84.

Suitable supports that can be used in the present invention are, for example, described in the above-cited *Research Disclosure,* RD Nos. 17643 (page 28) and 18716 (from page 647, right column, to page 648, left column).

The color photosensitive material according to the present invention can be subjected to developing process by the usual method described in the above-cited *Research Disclosure,* RD No. 17643, pages 28 and 29 and No. 18716, page 651, left to right column. The present color photosensitive material is subjected generally to water washing process or stabilizing process after the developing process, bleach-fix process, or fixing process.

The water washing step is generally carried out in such a manner that two or more tanks are arranged and countercurrent washing is used to save water. As a stabilizing process, instead of a water washing step a multi-step countercurrent stabilizing process as described in Japanese Patent Application (OPI) No. 8543/82 can be typically exemplified. In this step, 2 to 9 countercurrent baths are required. Into these stabilizing baths, various compounds are added to stabilize the image. Typical examples of such compounds include various buffers for adjusting, for example, the film pH to from 3 to 8, such as a combination of borates, metaborates, borax, phosphates, carbonates, potassium hydroxide, sodium hydroxide, aqueous ammonia, monocarboxylic acids, dicarboxylic acids, polycarboxylic acids, etc., formaldehyde and the like. Additionally, if required, various additives can be added such as a water softener (e.g., inorganic phosphoric acids, aminopolycarboxylic acids, organic phosphoric acids, aminopolyphosphonic acids, phosphonocarboxylic acids, etc.), a biocide (e.g., benzoisothiazolinones, isothiazolones, 4-thiazolinebenzimidazoles, halogenated phenols, etc.), a surface active agent, a brightening agent, a hardening agent, etc., and these additives may be used in combination.

As film pH adjusting agent after processing, ammonium salts are preferably added such as ammonium chloride, ammonium nitrate, ammonium sulfate, ammonium phosphate, ammonium sulfite, ammonium thiosulfate, etc.

The present invention can be applied to various color photosensitive materials. Typical examples of such color photosensitive materials are general-purpose or motion picture color negative films, color reversal films for slides or television, color papers, color positive films, color reversal papers, etc. The present invention can also be applied to black-and-white photosensitive materials using three-color coupler mixing as described in *Research Disclosure,* RD No. 17123 (July 1978).

The present invention is further illustrated in detail by the following examples, though the invention is not intended to be limited to these examples.

EXAMPLE 1

While an aqueous solution wherein 30 g of inert gelatin and 6 g of potassium bromide had been dissolved in 1 liter of distilled water was stirred at 60° C., 35 ml of an aqueous solution containing 5.0 g of silver nitrate and 35 ml of an aqueous solution containing 3.2 g of potassium bromide and 0.98 g of potassium iodide were added thereto at a flow rate of 70 ml per minute for 30 seconds, and the ripening was performed for 30 minutes to prepare a seed emulsion.

Then, prescribed amounts of 1 liter of an aqueous solution containing 145 g of silver nitrate and equimolar amounts of an aqueous solution of a mixture of potassium bromide and potassium iodide were added at a prescribed temperature, a prescribed pAg, and an addition speed near the critical growth speed to prepare tabular core emulsions. Then, equimolar amount of an aqueous solution of a mixture of potassium bromide and potassium iodide having a composition different from that for the preparation of the core emulsion and the remaining aqueous silver nitrate solution were added at an addition speed near the critical growth speed to cover the core, thereby preparing silver bromoiodide tabular grains A to of a core/shell type.

Except for the case of Emulsion D, the iodide distribution among pAg grains was set to be narrow when the core was adjusted.

Further, comparative cubic Emulsion J of a core/shell type wherein the iodide content in the core part was higher than the iodide content in the shell part was prepared in the similar manner suggested by the method described in European Patent No. 147,868A. To bring the average size and the aspect ratio of each emulsion to desired values, the temperature, the addition speed, and the pAg during the addition operation were adjusted.

The pAg was adjusted to bring the aspect ratios of Emulsions A, B, C, D, E, G, and H to about 7, and except the case of Emulsion E, the total iodide content was set to 6 mol %. With respect to the grain size, in all of Emulsions A to J the diameter corresponding to the diameter of a circle having an area equal to the projected area of the grain was adjusted to 0.8 μm. With respect to the grain size distributions, the relative standard deviations of Emulsions A to I were about 30%, which can be considered approximately the same.

TABLE 1

| Emulsion | Average iodide content (mol %) | Aspect ratio | Grain size[2] (μm) | Core/shell ratio (volume ratio) | Core/shell ratio, iodide content | Iodide content deviation among cores of grains (%) | Iodide content deviation among final grains (%) | Size distribution (%) |
|---|---|---|---|---|---|---|---|---|
| A* | 6.0 | 7.2 | 0.81 | 1/1 | 12/0 | 7 | 10 | 32 |
| B* | 6.0 | 7.0 | 0.83 | 1/1 | 12/0 | 9 | 16 | 34 |
| C* | 6.0 | 6.8 | 0.79 | 1/2 | 18/0 | 9 | 18 | 31 |
| D** | 6.0 | 6.8 | 0.79 | 1/1 | 12/0 | 15 | 27 | 31 |
| E** | 1.5 | 7.1 | 0.81 | 1/1 | 3/0 | 8 | 15 | 31 |
| F** | 6.0 | 4.8 | 0.80 | 1/3 | 24/0 | 10 | 20 | 32 |
| G** | 6.0 | 7.1 | 0.77 | 1/3 | 12/4 | 8 | 15 | 30 |
| H** | 6.0 | 7.0 | 0.79 | uniform | 6/6 | 5 | 10 | 30 |
| I** | 6.0 | 3.1 | 0.81 | 1/1 | 12/0 | 8 | 14 | 27 |
| J**[1] | 6.0 | cubic | 0.80 | 1/1 | 12/0 | 6 | 12 | 15 |

(Notes)
*according to the invention
**comparative example
[1]J is a cubic emulsion prepared in accordance with European Patent 147,868A.
[2]Diameter corresponding to the diameter of a circle having an area equal to the projected area of the grain.

As shown in Table 1, only when the iodide content deviation range among the cores of the grains is narrow, the iodide content deviation range among the final grains can be made narrow.

Emulsions A, B, and C are emulsions according to the present invention, Emulsion D is an example where the iodide content deviation among grains is broad, Emulsions E and F are respectively an example where the iodide content of the cores is too high and an example where the iodide content of the cores is too low, and Emulsions G, H, are examples wherein the iodide content of the shells is too high.

The characteristic values (the average iodide content, the iodide content of the core part, the iodide content of the shell part, the aspect ratio, the grain size, the core/shell ratio, the iodide content deviation among the grains, and the double structure character) of Emusions A to J are given in Table 1.

After the measured value of the average iodide content determined from the X-ray diffraction of the silver halide that had been annealed at 200° C. for 3 hours and the calculated value were confirmed to be approximately identical, the calculated value was shown. The iodide contents of the core part and the shell part were given as the calculated values. The grain size (diameter corresponding to the diameter of of a circle having an area equal to the projected area of the grain) was found by using a Coulter Counter (Coulter Co.) and the aspect ratio was found in accordance with the method described in Japanese Patent Application (OPI) No. 113928/83. The core/shell ratio is given in terms of calculated value.

The iodide content deviation among grains was determined in accordance with European Patent No. 147,868A. The double structure character was determined in accordance with the method described in Japanese Patent Application (OPI) No. 143331/85.

For reference, peak profiles of the X-ray diffraction of Emulsions A and I are given in the accompanying drawing, wherein the diffraction angle ($2\theta$) is plotted as abscissa and the X-ray diffraction strength as ordinate.

As is clear from Table 1, in Emulsions A to C and E to I where the pAg is set so that the iodide content deviation among the cores of the grains is narrow, the iodide content deviation among the final grains is also narrow in comparison with Emulsion D where the pAg is not set so that the iodide content deviation among the cores of the grains is narrow.

The above ten Emulsions were chemically sensitized, respectively, most suitably with sodium thiosulfate and chloroauric acid, then optimum amounts of a solution containing sensitizing dye A in methanol were added to them respectively, and they were heated at 40° C. for 15 minutes to be color sensitized.

The Emulsions and protective layers were applied in amounts given in Table 2 on each triacetylcellulose film support provided with a subbing layer.

TABLE 2

| | |
|---|---|
| (1) Emulsion Layer | |
| Emulsion: | Emulsions A to J given in Table 1. (silver $2.1 \times 10^{-2}$ mol/m$^2$) |
| Coupler: | ($1.5 \times 10^{-3}$ mol/m$^2$) 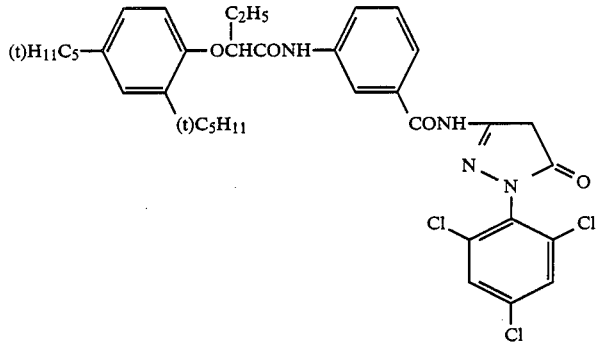 |
| Tricresyl phosphate: | (1.10 g/m$^2$) |
| Gelatin: | (2.30 g/m$^2$) |
| (2) Protective layer | |
| 2,4-dichlorotriazine-6-hydroxy-s-triazine sodum salt: | (0.08 g/m$^2$) |
| Gelatin: | (1.80 g/m$^2$) |

After these samples were allowed to stand for 14 hours at 40° C. and a relative humidity of 70%, they were exposed for sensitometry and subjected to color development processing as described below.

The density of each of the processed samples was measured using a green filter.

The development processing used therein was carried out under the conditions given below at 38° C.

| | |
|---|---|
| 1. Color development | 2 min. 45 sec. |
| 2. Bleach | 6 min. 30 sec. |
| 3. Washing | 3 min. 15 sec. |
| 4. Fixing | 6 min. 30 sec. |
| 5. Washing | 3 min. 15 sec. |
| 6. Stabilizing | 3 min. 15 sec. |

The compositions of processing solutions used in steps were as follows:

| | |
|---|---|
| Color developing solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methyl-aniline sulfate | 4.5 g |
| Water to make | 1 liter |
| Bleaching solution: | |
| Ammonium bromide | 160.0 g |
| Ammonia water (28%) | 25.0 ml |

Sensitizing Dye A

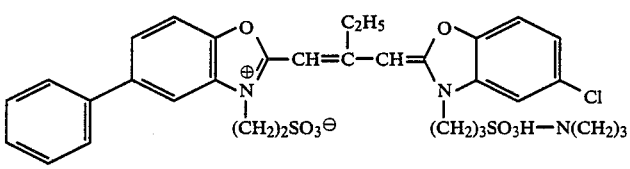

-continued

| | |
|---|---|
| Sodium ethylenediaminetetra-acetato ferrate | 130 g |
| Glacial acetic acid | 14 ml |
| Water to make | 1 liter |
| Fixing solution: | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Stabilizing solution: | |
| Formalin (37 wt % formaldehyde solution) | 8.0 ml |
| Water to make | 1 liter |

The results of the measurement of the graininess and the sensitometry and the data on the transparency are given in Table 3.

TABLE 3

| Sample No. | Emulsion | Fog | Blue[1] sensitivity | Green[1] sensitivity | Gamma[2] | RMS[3] graininess | Trans-[4] parency |
|---|---|---|---|---|---|---|---|
| 1 | A* | 0.15 | 150 | 200 | 1.68 | 0.031 | 0.76 |
| 2 | B* | 0.14 | 140 | 180 | 1.60 | 0.033 | 0.73 |
| 3 | C* | 0.15 | 135 | 175 | 1.58 | 0.035 | 0.72 |
| 4 | D** | 0.16 | 95 | 120 | 1.40 | 0.040 | 0.65 |
| 5 | E** | 0.13 | 80 | 105 | 1.67 | 0.049 | 0.70 |
| 6 | F** | 0.15 | 95 | 125 | 1.58 | 0.036 | 0.51 |
| 7 | G** | 0.17 | 50 | 65 | 1.20 | 0.033 | 0.70 |
| 8 | H** | 0.15 | 50 | 65 | 1.10 | 0.031 | 0.71 |
| 9 | I** | 0.16 | 100 | 120 | 1.50 | 0.033 | 0.40 |
| 10 | J** | 0.15 | 100 | 100 | 1.45 | 0.030 | 0.36 |

(Notes)

*according to the invention

**comparative example

[1]The sensitivity of sample 10 was defined as 100, and the sensitivity of each of others was given comparatively.

[2]The density difference between the point of the fog plus a density of 0.2 and the point where the exposure was 10 times as high as the former.

[3]The RMS value obtained by using an aperture of 48 μ diameter to measure the density of the sample that had been exposed by an exposure giving density of 2.0 followed by processing.

[4]The ratio of the intensity of the specular transmitted light component to the intensity of incident, when specular light of 600 nm was struck on the coated Sample Nos. 1 to 10.

As shown in Table 2, in comparison to low aspect ratio tabular Emulsion I, high aspect ratio tabular Emulsions A and B are high in green sensitivity and transparency.

In comparison to the Emulsions A, B, and C according to the present invention, an emulsion that has a high aspect ratio and is good in transparency cannot be produced if the iodide content of the core tabular grain of emulsion is 20% or over as in the case of Emulsion F. On the other hand, if the iodide content of the core tabular grain of emulsion is lower than 4 mol % as in the case of Emulsion E, the graininess becomes unfavorable. When the Emulsions A and B according to the present invention and the Emulsions G and H are compared, the higher the iodide content of the shell, the lower the sensitivity, resulting in soft gradation. As apparent from the above data, it is shown that suitable halogen compositions of a double structure tabular grain emulsion are ones as described under "Summary of the Invention" mentioned above.

Emulsion D is an emulsion wherein the pAg at the time when the core is prepared is set to be a value that would not let the iodide content deviation among grains be narrow in the same step as that of Emulsion B.

Emulsion A is an emulsion obtained by setting the pAg at the tim when the core is prepared in the same step as that of Emulsion B to be an optimum pAg that will result in the iodide content deviation among the grains being narrow. When Emulsions A, B, and D are compared, it is apparent that when the iodide content deviation among grains is narrowed, it is effective to increase the sensitivity, to obtain soft gradation and to improve the graininess and transparency.

When the Emulsion A according to the present invention is compared with Comparative Emulsion J prepared in accordance with European Patent 147,868A, then in spite of the fact that with respect to the green sensitivity, Emulsion A is twice as high as that of Emllsion J when the graininess is the same, Emulsion A is excellent in transparency.

EXAMPLE 2

Emulsion K wherein in the iodide content deviation among grains the qrain size is large and the iodide content is high, Emulsion L wherein the grain size is independent of the iodide content deviation among grains, and Emulsion M wherein in the iodide content deviation among grains the grain size is small and the iodide content is high were prepared by changing the pAg during the growth of cores and during attaching of shells in the step similar to that in Example 1.

TABLE 4

| Emulsion | Aspect ratio | Diameter[2] (μm) | Core/shell volume ratio | Core/shell ratio, iodide content | Iodide content deviation among the grains (%) | Relative relation[1] between grain size and iodide content |
|---|---|---|---|---|---|---|
| K** | 6.2 | 0.83 | 1/1 | 12/0 | 35 | 9 |
| L* | 7.1 | 0.81 | 1/1 | 12/0 | 16 | 1 |

TABLE 4-continued

| Emulsion | Aspect ratio | Diameter[2] (μm) | Core/shell volume ratio | Core/shell ratio, iodide content | Iodide content deviation among the grains (%) | Relative relation[1] between grain size and iodide content |
|---|---|---|---|---|---|---|
| M** | 6.5 | 0.78 | 1/1 | 12/0 | 32 | −8 |

(Notes)
*according to the invention
**comparative example
[1]Expressed as a gradient of the straight line obtained by taking the iodide content Yi (mol %) of each grain and the grain size Xi (μm) and determining by the method of least squares from each point of the points (Xi, Yi).
[2]Diameter corresponding to the diameter of a circle having an area equal to the projected area of the grain.

In a similar manner to that for Example 1, Emulsions K, L, and M were chemically sensitized, color sensitized, then applied, and processed. The data on the sensitometry, the graininess and the transparency of the samples are set forth in Table 5.

TABLE 5

| Sample No. | Emulsion | Fog | Blue[1] sensitivity | Green[1] sensitivity | Gamma[2] | RMS[3] graininess | Trans[4] parency |
|---|---|---|---|---|---|---|---|
| 12 | K | 0.14 | 100 | 100 | 1.25 | 0.035 | 0.68 |
| 13 | L | 0.16 | 110 | 120 | 1.65 | 0.033 | 0.75 |
| 14 | M | 0.15 | 90 | 90 | 1.59 | 0.044 | 0.65 |

(Notes)
[1]relative value with the sensitivity of Sample 12 defined as 100
[2–4]have the same meaning as in TABLE 3

As shown above, the Emulsion L according to the present invention is excellent in sensitivity, graininess, and gradation in comparison with the other two emulsions.

While the invention has been described in detail and with reference to specific embodiments thereof, it will be apparent to one skilled in the art that various changes and modifications can be made therein without departing from the spirit and scope thereof.

What is claimed is:

1. A photosensitive silver halide emulsion whose grain diameter/grain thickness ratio is 5 or more wherein the grains of said emulsion each comprises a core that consists substantially of silver bromoiodide containing from 4 to 20 mol % of silver iodide, and a shell that covers said core and consists substantially of silver bromide or silver bromoiodide containing 3 mol % or less of silver iodide, and the relative standard deviation of the silver iodide content among the grains of said emulsion is 20% or less.

2. A photosensitive silver halide emulsion as in claim 1, wherein the grains of said emulsion each comprises a core that consists substantially of silver bromoiodide containing from 6 to 15 mol % of silver iodide.

3. A photosensitive silver halide emulsion as in claim 1, wherein the relative standard deviation of the silver iodide content among the cores of the grains of said emulsion is 15% or less.

4. A photosensitive silver halide emulsion as in claim 1, wherein the relative standard deviation of the silver iodide content among the cores of the grains of said emulsion is 8% or less.

5. A photosensitive silver halide emulsion as in claim 2, wherein the relative standard deviation of the silver iodide content among the cores of the grains of said emulsion is 15% or less.

6. A photosensitive silver halide emulsion as in claim 2, wherein the relative standard deviation of the silver iodide content among the cores of the grains of said emulsion is 8% or less.

7. A photosensitive silver halide emulsion as in claim 1, wherein the grains of said emulsion each comprises a shell that consists substantially of silver bromide or silver bromoiodide containing 1.5 mol % or less of silver iodide.

8. A photosensitive silver halide emulsion as in claim 1, wherein the volume ratio of the core to the shell of the grains of said emulsion ranges from $\frac{1}{4}$ to 4/1.

9. A photosensitive silver halide emulsion as in claim 1, wherein the volume ratio of the core to the shell of the grains of aid emulsion ranges from $\frac{1}{2}$ to 2/1.

10. A photosensitive silver halide emulsion as in claim 1, wherein the average thickness of the shells of the grains of said emulsion in the Z-axis direction is from 0.01 to 0.1 μm and the average thickness thereof in the X-Y plane direction is from 0.02 to 0.5 μm.

11. A photosensitive silver halide emulsion as in claim 1, wherein the average thickness of the shells of the grains of said emulsion in the Z-axis direction is from 0.02 to 0.06 μm and the average thickness thereof in the X-Y plane direction is from 0.05 to 0.4 μm.

12. A photosensitive silver halide emulsion as in claim 1, wherein the ratio of the thickness of the shell of the grain of said emulsion in the Z-axis direction to the thickness thereof in the X-Y plane direction is from 1/1 to 1/20.

13. A photosensitive silver halide emulsion as in claim 1, wherein the ratio of the thickness of the shell of the grain of said emulsion in the Z-axis direction to the thickness thereof in the X-Y plane direction is from 1/1 to $\frac{1}{8}$.

14. A photosensitive silver halide emulsion as in claim 1, wherein the ratio of the thickness of the shell of the grain of said emulsion in the Z-axis direction to the thickness thereof in the X-Y plane direction is from 1/1 to 1/5.

15. A photosensitive silver halide emulsion as in claim 1, wherein the diameter of the grain of said emulsion that corresponds to the diameter of a circle having an area equal to the projected area of the grain is from 0.2 to 3.0 μm.

16. A photosensitive silver halide emulsion as in claim 1, wherein the diameter of the grain of said emulsion that corresponds to the diameter of a circle having an area equal to the projected area of the grain is from 0.3 to 2.0 μm.

17. A photosensitive silver halide emulsion as in claim 1, wherein the relative standard deviation of the silver iodide content among the grains of said emulsion is 12% or less.

18. A photosensitive silver halide emulsion as in claim 1, wherein the grain diameter/grain thickness ratio of said emulsion is from 5 to 20.

19. A photosensitive silver halide emulsion as in claim 18, wherein the grain diameter/grain thickness ratio of said emulsion is from 5 to 8.

20. A photosensitive silver halide emulsion as in claim 19, wherein the grain diameter/grain thickness ratio of said emulsion is from 6.5 to 8.

21. A photosensitive silver halide emulsion as in claim 17, wherein the grain diameter/grain thickness ratio of said emulsion is from 5 to 8.

22. A photosensitive silver halide emulsion as in claim 21, wherein the grain diameter/grain thickness ratio of said emulsion is from 6.5 to 8.

23. A photosensitive silver halide emulsion as in claim 3, wherein the grain diameter/grain thickness ratio of said emulsion is from 5 to 8.

24. A photosensitive silver halide emulsion as in claim 23, wherein the grain diameter/grain thickness ratio of said emulsion is from 6.5 to 8.

25. A photosensitive silver halide emulsion as in claim 4, wherein the grain diameter/grain thickness ratio of said emulsion is from 5 to 8.

26. A photosensitive silver halide emulsion as in claim 25, wherein the grain diameter/grain thickness ratio of said emulsion is from 6.5 to 8.

* * * * *